US011021869B2

(12) United States Patent
Schaub-Manthei

(10) Patent No.: US 11,021,869 B2
(45) Date of Patent: Jun. 1, 2021

(54) GAP BRIDGING DEVICE

(71) Applicant: MIGUA Fugensysteme GmbH, Wuelfrath (DE)

(72) Inventor: Markus Schaub-Manthei, Muelheim (DE)

(73) Assignee: MIGUA Fugensysteme GmbH, Wuelfrath (DE)

( * ) Notice: Subject to any disclaimer, the term of this patent is extended or adjusted under 35 U.S.C. 154(b) by 0 days.

(21) Appl. No.: 16/774,592

(22) Filed: Jan. 28, 2020

(65) Prior Publication Data

US 2020/0224410 A1 Jul. 16, 2020

(30) Foreign Application Priority Data

Jan. 14, 2019 (DE) ..... 2020 19 100 160.7
Jan. 14, 2019 (DE) ..... 2020 19 100 165.8

(51) Int. Cl.
*E04B 1/68* (2006.01)
*E04F 15/02* (2006.01)

(52) U.S. Cl.
CPC ..... *E04B 1/6804* (2013.01); *E04F 15/02016* (2013.01)

(58) Field of Classification Search
CPC ..... E04B 1/6804; E04F 15/02016
USPC ..... 52/396.04
See application file for complete search history.

(56) References Cited

U.S. PATENT DOCUMENTS 3,263,386 A * 8/1966 Kimmel ..... E04B 1/68 52/580
3,375,763 A * 4/1968 Welch ..... E01D 19/06 404/67
3,720,474 A * 3/1973 Stog et al. ..... E01D 19/06 404/47
3,822,428 A * 7/1974 Stag ..... E01D 19/06 14/73.1

(Continued)

FOREIGN PATENT DOCUMENTS

CH 488880 A * 4/1970 ..... E04B 1/6804
DE 2549041 A1 * 5/1977 ..... E04B 1/6804

(Continued)

OTHER PUBLICATIONS

Wolf Andreas EP 2053172 A2 20090429 Translated Per espace.com "16774592_2020-10-27_EP_2053172_A2_M translated".pdf https://worldwide.espacenet.com/publicationDetails/biblio?CC=EP&NR=2053172A2&KC=A2&FT=D&ND=5&date=20090429&DB=EPODOC&locale=en_EP (Year: 2020).*

*Primary Examiner* — Patrick J Maestri
*Assistant Examiner* — Joseph J. Sadlon
(74) *Attorney, Agent, or Firm* — Von Rohrscheidt Patents

(57) ABSTRACT

A gap bridging device including two anchoring devices that anchor the gap bridging device at two building elements that are separated from each other by a gap; and a bridging device that is connected with one of the two anchoring devices respectively at longitudinal sides of the bridging device that are arranged opposite to each other, so that position changes of the building elements relative to each other are compensated by a shape-change of the bridging device, wherein the two anchoring devices respectively include a base element that is anchorable at one of the two building elements and a top element that is connected with (Continued)

the base element by a plurality of bolts in a force transferring manner and connected with the gap bridging device.

11 Claims, 4 Drawing Sheets

(56) References Cited

U.S. PATENT DOCUMENTS 4,022,538 A * 5/1977 Watson ..... E01C 11/126 404/69
4,332,504 A * 6/1982 Arai ..... E01D 19/06 14/73.1
4,358,217 A * 11/1982 Stone ..... E01F 9/553 404/16
4,773,791 A * 9/1988 Hartkorn ..... E01D 19/06 404/56
5,384,996 A 1/1995 Nicholas
5,711,119 A * 1/1998 Cornils ..... B60J 10/70 52/208
5,799,456 A * 9/1998 Shreiner ..... E04B 1/6803 52/396.04
6,854,737 B2 * 2/2005 Fieger ..... E04B 1/6804 277/630
8,671,489 B2 * 3/2014 Gallai ..... E01D 19/06 14/73.1
8,769,883 B2 * 7/2014 Bazzarini ..... E04B 1/681 52/28
9,890,541 B2 * 2/2018 Hullenkremer ..... B29C 70/76
9,909,309 B1 * 3/2018 Conklin ..... B32B 17/10293

FOREIGN PATENT DOCUMENTS

DE 3015011 A 10/1981
DE 3811082 C1 12/1989
DE 3828980 A1 3/1990
DE 4303369 C1 3/1994
DE 10208359 A1 9/2003
DE 102008061612 A1 * 6/2010 ..... E04F 15/02016
DE 102011008898 A1 * 7/2012 ..... F21V 21/025
EP 2053172 A2 * 4/2009 ..... E04B 1/6803
JP 03063341 A * 3/1991 ..... E04F 15/02016

* cited by examiner

GAP BRIDGING DEVICE

RELATED APPLICATIONS

This application claims priority from and incorporates by reference German Utility Model application DE 20 2019 100 160.7 filed on Jan. 14, 2019, and German Utility Model application DE 20 2019 100 165.8 filed on Jan. 14, 2019, both of which are incorporated into this reference in their entirety.

FIELD OF THE INVENTION

The invention relates to a gap bridging device.

BACKGROUND OF THE INVENTION

In order to preclude tension cracks in buildings that are caused by environmental conditions or load conditions, the buildings are typically provided with engineered gaps that divide the buildings into individual building elements. The gaps facilitate positions changes of the building elements relative to each other and prevent a generation of forces in the building early on that would otherwise cause tension cracks.

The gap bridging devices facilitate bridging the individual building elements in spite of the movements relative to each other in order to provide a flat, gap-free transition surface. Thus, the gap bridging devices are connected with the building elements in a force transferring manner and compensate the relative movements by bridging and anchoring devices that are movably connected with each other. The anchoring devices are bolted together with the respective building elements and are partially covered by a flooring material, whereas the bridging devices advantageously extend in an identical plane with a surface of the flooring material above the gaps.

With respect to wear of the bridging device, e.g., wear of a surface profile that prevents slipping or due to maintenance, it can become necessary that at least parts of the gap bridging device, in particular the bridging device, can be replaced or temporarily removed.

However, also changing an optical appearance of the visible surface of the gap bridging device can make it necessary to replace the gap bridging device and the connected top elements of the anchoring devices. Thus, e.g., a change between different types of anodizing of extruded aluminum profiles or of an anodized surface into a non-anodized surface or vice versa can be implemented. Last not least, required changes of a thickness of the flooring material can make it necessary to replace bridging devices and top elements of the anchoring devices.

A generic device of this type for bridging gaps between two building elements can be derived from German patent application DE 38 28 980 A1. A gap bridging device is disclosed that is made from two anchoring devices and a bridging device. The bridging device includes two bridging members which engage each other in a telescoping manner and which are respectively linked together by an anchoring device through a groove that is arch-shaped in cross-section and which includes an accordingly configured arch-shaped tongue in order to compensate for relative movements between the building components. The anchoring devices are bolted together with building components and subsequently partially covered by a mortar layer or another flooring material so that a floor surface is created that is overall flat. Advantageously the anchoring devices are configured in two components as top element and base element in order to facilitate an adaptation of the gap bridging device to a thickness of the flooring material by selecting the top element.

It is a disadvantage that the top element and base element of the anchoring devices are directly adjacent to the flooring material. This has the effect that the anchoring devices cannot be separated from the building elements when the building elements are replaced without removing the adjacent flooring material. This requires complex cutting and grinding steps that cause noise and contamination and subsequently require complex cleaning work before a reassembly can be performed. Replacing the bridging members which are inserted into the arcuate groove of the top elements before installing the gap bridging device is also only possible with considerable complexity. Furthermore, separating the top element and the base element requires a relative linear movement of the components recited supra over their entire length so that a removal of the top element is hardly possible in practical application.

Another gap bridging device which is suitable in particular for applications in more humid environments can be derived from the "FPG 90 NI kF" by "MIGUA". The described gap bridging device includes an elastic bridging device which is clamped at a side that is oriented away from the gaps wherein the clamping is performed between a base element and a top element of the anchoring device. The edge portions of the gap bridging device seal against water and are enveloped by a downward folded section of the top element of the anchoring devices. The base elements of the anchoring devices are bolted together with the respective building component and are enveloped by the flooring material.

In order to remove the bridging device from a gap bridging device that has already been installed without removing the flooring material, the flooring material has to be applied due to the downward folded section of the top element so that a gap is created between the top element of the anchoring device and the flooring material so that the top element does not come in contact with the flooring material. The formation of the gap, however, leads to an unintentional accumulation of moisture and contaminant in the gap.

DE 30 15 011 A1 discloses an expansion joint bridging device where a tongue-shaped bridging element engages a fork-shaped bridging element so that the bridging unit thus formed is attached at both opposite sides by a round bar in a complementary bearing groove of the respective anchoring unit without having a pivot joint so that the known device is only suitable for compensating horizontal movements of the building components that define the gap, but not for compensating vertical movements that are facilitated by the pivot joint between the bridging unit and the anchoring units, in particular its top element according to this invention. Additionally the top elements of the anchoring units are only plugged onto the base elements, wherein all support forces are merely generated by friction forces and clamping forces.

DE 38 11 082 C1 illustrates another device for bridging a gap where pivotability is provided within the bridging device and where the top elements of the anchoring units are connected with the respective base element by bolts. The bolts engage nuts that are supported so that they are movable in a longitudinal direction in undercut grooves in the base elements of the anchoring device. In order react the required forces that act in the vertical direction of the device, the top elements have a thickness that is not too small and therefore removing the top elements requires removal and damaging adjacent portions of the flooring material to a large extent.

Additional bridging devices are known from the documents DE 102 08 359 A1, DE 43 03 369 C1 and U.S. Pat. No. 5,384,996. All known devices have in common that substantial damages to the adjacent flooring material are unavoidable when replacing the top element of the anchoring units or that rather weak top elements are only connected with the associated base elements by clamping or friction forces.

Generally difficulties and complexity when replacing bridging units cause a longer downtime of the respective building section and thus typically substantial financial losses.

BRIEF SUMMARY OF THE INVENTION

Thus it is an object of the invention to develop an alternative gap bridging device which is characterized by a particularly simple option to remove the bridging device.

Improving upon the gap bridging device recited supra, the object is achieved by a gap bridging device including two anchoring devices that anchor the gap bridging device at two building elements that are separated from each other by a gap; and a bridging device that is connected with one of the two anchoring devices respectively at longitudinal sides of the bridging device that are arranged opposite to each other, so that position changes of the building elements relative to each other are compensated by a shape-change of the bridging device, wherein the two anchoring devices respectively include a base element that is anchorable at one of the two building elements and a top element that is connected with the base element by a plurality of bolts in a force transferring manner and connected with the gap bridging device, wherein the base element includes a divider bar that extends adjacent to the top element on a side of the top element that is oriented away from the gap so that the divider bar extends towards a surface of a flooring material that adjoins the gap bridging device, wherein the top element is removable from the base element in an installed condition of the base element without causing damage to the gap bridging device or the flooring material, wherein a distance of a face of the divider bar that is oriented towards the surface of the flooring material from the surface of the flooring material is 8 mm at the most or 6 mm at the most or 4 mm at the most, wherein the top element and the base element are supported at each other in a portion of opposing contact surfaces so that forces are transferrable that are orthogonal to the surface of the flooring material, and wherein the contact surfaces have a greater distance from the surface of the flooring material than the face of the divider bar.

"Adjacent" in this context means an arrangement with a distance of the divider bar from the gap measured in horizontal direction that is greater than the distance of the top element from the gap.

It is a particular advantage of the device according to the invention that a height of a contact surface between the top element of the anchoring device and the flooring material is 8 millimeters, advantageously 6 millimeters at the most, further advantageously 4 millimeters at the most. This prevents that the flooring material, e.g., a mortar compound, a glue or an elastic gap filling compound, retains the top elements of the anchoring devices so that removing the anchoring devices is only possible by removing or destroying the surrounding flooring material. Rather the top element is only connected at the small contact surface with the flooring material so that damages during disassembly can be kept small and disassembly forces can be kept small.

In the gap bridging device according to the invention each base element of the anchoring device is advantageously L-shaped so that the top element is inserted into a capital L geometry whose arm that extends perpendicular to the flooring material is formed by the divider bar. The respective top element thus has a thickness that is measured orthogonal to a plane of the flooring material, wherein the thickness is at least 50% of a total thickness of the anchoring unit, this means the total thickness is formed by a distance of a bottom side of the base element that is oriented to the respective component from a top side of the respective base element that forms a top side of the gap bridging device.

Additionally a top horizontal tangential plane of the base element in a portion of the base element outside of the divider bar, this means at a side of the divider bar that is oriented towards the gap, is arranged lower than the upper face of the divider bar. Typically the tangential plane in the section of the base element oriented towards the gap substantially corresponds to the contact surface of the base element that is arranged further above. Further advantageously an open cross-section of an advantageously undercut groove will be located in the tangential plane, wherein the groove is configured for receiving nuts so that bolts can be threaded in that are run through the top element so that the top element is connected with the base element.

Advantageously the dismounting direction of the top elements of the anchoring device is orthogonal to a contact surface of the base element of the anchoring device. Furthermore, it is advantageous that the bridging device is mounted or dismounted together, this means joined with the two top elements of the anchoring units coupled therewith.

Advantageously a portion that is adjacent to the top of the anchoring device is not completely filled with the flooring material but closed by an elastic gap sealing compound. The thickness of the layer only has to correspond to the distance described supra if there is a distance at all between the surface of the flooring material and the face of the divider bar. Thus, the replacement or the removal of the top element and thus also of the bridging device can be performed in a rather simple manner by cutting off the elastic gap sealing compound e.g. with a knife without having to remove a portion of the actual solid massive flooring material.

In one embodiment of the gap bridging device according to the invention the face of the divider bar extends to a surface of the top element of the anchoring device. This embodiment has the advantage that is it assured that the top element of the anchoring device is completely separated by the divider bar of the base element from the flooring material. Therefore no elastic gap sealing compound is required to close the surfaces that are adjacent to the divider bar. The adjacent portion can be completely filled by the flooring material. The top elements of the anchoring devices and the bridging device can thus be replaced in a particularly simple manner without removing the flooring material in case there is wear or in case the requirements for the gap bridging device have changed.

According to a particularly advantageous embodiment of the invention a face of the divider bar that is oriented away from the base element is completely flat. This means that the face does not have any steps, waves, recesses, notches or similar but is straight and in particular parallel to the contact surface of the base element of the anchoring device. This way the divider bar can perform its function to form a shield or a separation relative to the flooring material that facilitates a disengagement of the top element from the base element in an optimum manner. In particular when the face of the divider bar extends to the surface of the flooring material a non-flat shape of the face is hardly acceptable from an aesthetic point of view and would make disengaging the flooring material or the elastic gap sealing compound from the top element unnecessarily difficult in a portion of the recesses in the face when flooring material or gap material reaches adjacent to the top element in a portion of the recesses.

According to an advantageous embodiment the top element of the anchoring device does not extend further away from the gap than to a side surface of the divider bar of the base element that is oriented away from the gap. An embodiment of this type has the advantage that the top element of the anchoring device does not come in contact with the flooring material outside of the contact portion described supra. This has the effect that the top element with the bridging device attached thereto are removable in a particularly simple manner without having to keep a gap between the top element and the flooring material clear.

The bridging device can be configured e.g. as an elastic synthetic material element, in particular made from rubber or another elastomeric material. Under the occurring movement of the building elements relative to each other the deformability of the synthetic material element assures that the gap is bridged without a fracture forming in spite of the movement. With respect to mechanical load bearing capability of the gap bridging device, however, it can be alternatively advantageous when the bridging device is not formed by an elastic bridging member but by a plurality of rigid bridging members made from metal or synthetic material in particular bridging members with fiber reinforcement which are moveable relative to each other wherein position changes of the building elements relative to each other can be compensated by at least one relative movement of adjacent bridging members. It is advantageous that the bridging arrangement is formed by two metal bridging members that engage each other in a telescoping manner which compensates relative movements of the building elements relative to each other and which can bear higher loads due to their material properties. Therefore the gap bridging device can also be driven over by heavy vehicles.

In one embodiment of the gap bridging device according to the invention both top elements and the bridging devices connected therewith are jointly removable from the base elements of the anchoring devices in an installed condition of the base elements of the anchoring device essentially without damaging the top elements and the bridging devices. Since the top elements are removable from the base elements without damage new components can be installed in a particularly simple manner in case there is a defect or there is wear of a top element or of the bridging device without having to replace the base element. This leads in particular to a reduced labor and material requirement.

According to an advantageous embodiment it is provided that the gap bridging device includes at least one connection element, advantageously a plurality of connection elements by which the top element of the anchoring device is attachable at the base element of the anchoring device. In order to obtain reliable support for the top element and the bridging device connected therewith the top element has to be connected in a force transferring manner with base elements of the anchoring device that are bolted together with the respective building elements or connected therewith by mortar. The connection elements which can be respectively configured as a bolt and a rectangular nut are thus inserted into the top element or into the base element wherein bolts that are run through the top element of the anchoring device are connected with nuts that are supported in the base element.

An advantageously embodiment of the invention provides that the base element of the anchoring device advantageously includes an undercut groove, wherein the cross section of the groove is advantageously T-shaped. Thus, a groove is desirable in that a receiver for the nut of the at least one connection element is provided which is connected with the base element in a form locking manner, so that transversal forces which are introduced into the top elements and/or the bridging arrangement from an outside can also be introduced into the base elements. Advantageously the groove is configured with a T-shaped cross section so that the top element can be coupled with the base element by forming a corresponding cross section.

In one embodiment of the gap bridging device according to the invention a width of a nut of a connection element is smaller than a length of the nut of the connection element, wherein a width of the nut is smaller than a minimum width of the groove of the base element of the anchoring device and a length of the connection element is greater than a minimum width of the groove of the base element of the anchoring device.

The ratio of side dimensions recited supra facilitates that the nut can be inserted into the groove of the base element in a first orientation in a simple manner. The length of the nut that is increased relative to a minimum width of the base element assures that the nut which is essentially configured as a rectangular nut cannot be rotated in the groove without stop when connected with a bolt. The nut rather locks in a second orientation in the groove of the base element and thus prevents further co-rotation so that a force transferring connection can be established between the top element and the base element of the anchoring device during continued threading of the bolt.

Advantageously two edges of the nut that are arranged diagonally opposed to each other are rounded. An embodiment of this type is particularly well suited to connect the top elements with the base elements of the anchoring device. Forming the edges rounded allows to wedge the nut when the nut is rotated in the groove of the base element of the anchoring device. Thus, the nut has to be rotated so that the rounded edges are oriented in a direction of the opposite side surfaces of the groove of the base element. Due to an increased length of the nut relative to the maximum width of the groove the nut is eventually wedged in the groove. Thus a manual holding of the nut like e.g. when using a freely rotatable nut is not required any more.

BRIEF DESCRIPTION OF THE DRAWINGS

The invention is now described based on embodiments with reference to drawing figures, wherein.

DETAILED DESCRIPTION OF THE INVENTION

Figure 1:
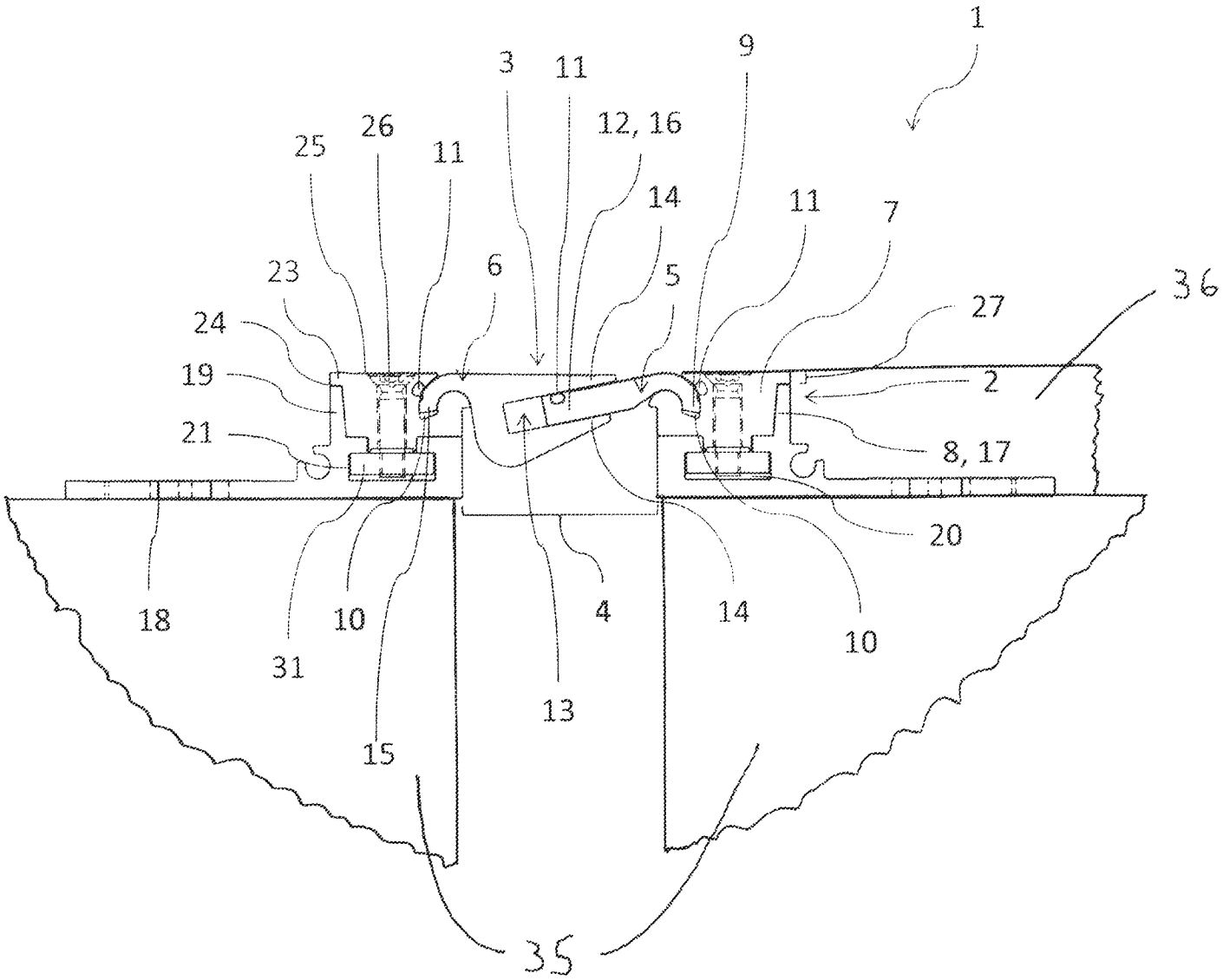
FIG. 1 illustrates a vertical sectional view of a gap bridging device according to the invention.

FIG. 1 illustrates a vertical sectional view of a gap bridging device 1 according to the invention which is anchorable at two building elements 35. The gap bridging device 1 is configured rail shaped an includes two anchoring devices 2 that are arranged in a mirror symmetrical pattern and that are respectively elongated and extend parallel to a gap 4 and a bridging device 3. The anchoring devices 2 respectively include a top element 7 and a base element 8 wherein the top element 7 is connected with the base element 8 in a form locking and force transferring manner. The two base elements 8 of the anchoring devices 2 are attached at the building elements that are separated from each other by the gap 4. The bridging device 3 that extends over the gap 4 includes two bridging members 5, 6 which engage each other in a tongue and groove connection in a telescoping manner.

The first bridging member 5 of the bridging device 3 is configured with I-shaped cross section and pivotably anchored in an adapted arcuate groove 10 of the top element 7 of the first anchoring device 2 at an arcuate end 9 of the first bridging member 5. The groove 10 of the top element 7 is formed by a wall section in an outer cylinder and in an inner cylinder. In order to prevent an entry of humidity or contamination into the groove 10 of the top element 7 and thus prevent an impairment of the movement compensation the top element 7 includes a groove in the external cylindrical section with a seal thread 11 inserted into the groove. The straight end 12 of the I-shaped bridging member 5 acts as a spring 16 and engages an accordingly configured groove 13 of the second bridging member 6 in a telescoping manner. The first bridging member 5 also includes a groove that is provided with a seal thread 11 which prevents humidity or contamination entering the groove 13 of the second bridging member 6.

The groove 13 of the second bridging member 6 is defined by two arms 14 that have a cross section that tapers into a point. In analogy to the first bridging member 5 an arcuate end of the second bridging member 6 that is oriented away from the gap 4 is pivotably anchored in a corresponding groove 10 of the top element of the second anchoring device 2.

The telescoping engagement of the first bridging member 5 in the groove 13 of the second bridging member 6 facilitates compensating horizontal movements of the two building elements relative to each other by moving the tongue 16 in the groove 13. The pivotable connection of the bridging members 5, 6 at the top element 7 of the anchoring devices 2 also facilitates compensating vertical movements of the building elements relative to each other without creating a step in a transition portion between the building elements.

The base elements 8 of the anchoring devices 2 are configured as a T-shaped groove rail 17. The base surface of the T-shaped groove rail is extended on one side. The extension 18 of the T-shaped groove rail 17 is provided with holes and slotted holes which are described with reference to FIG. 2 in order to connect the gap bridging device 1 with the building elements by screws. Furthermore the T-shaped groove rail 17 has a divider bar 19 on a side surface that is oriented away from the gap 4 in an extension of the side surface, wherein the divider bar protrudes beyond a surface of the T-groove rail 17 that is oriented towards the gap.

A section of the top elements 7 of the anchoring devices 2 that is oriented towards the building elements is configured T-shaped as a counter element to the base element and can thus be inserted in a form locking manner into an accordingly adapted grove of the base element 8. The undercut lower section 21 of the groove 20, however, is not filled by the top element and remains free for an insertion of nuts 31 that are described with reference to FIG. 3.

The top element 7 is provided with the groove 10 described supra at a side that is oriented towards the gap 4 in order to support the respective bridging member 5, 6. A cross sectional shape of the top element 7 is adapted to a shape of the base element 8 on a side that is oriented towards the gap 4. An upper horizontal bar 23 of the top element 7 contacts a face 24 of the divider bar 19.

The top element 7 is provided with bore holes 25 in uniform intervals. In order to connect the top elements 7 with the base elements 8 that are already bolted together with the building elements, bolts 26 are run through the bore holes 25 of the top elements 7 and threaded together with nuts 31 at a bottom side. A bolt 26 and a nut 31 in combination form a connection element 22.

In order to achieve a flat transition between the gap bridging device 1 and the adjacent floor a space above a plane that is defined by an elongated base surface of the base element 8 is filled with a flooring material 36, e.g. screed or flooring plates. Due to the shape of the divider bar 19 a contact surface 27 between the flooring material and the top element 7 is approximately 3 mm in the instant case. In order to assure a simple removal of the top elements 7 and the bridging device 3 a portion directly adjacent to the contact surface 27 is not closed by the flooring material but by an elastic gap filling material which can be cut in a rather simple manner e.g. by a cutter blade and removed thereafter to expose the contact surface 27.

All components of the gap bridging device 1 besides the seal threads are made from extruded aluminum but can also be made from steel or other metals. Alternatively also synthetic materials, in particular with fiber reinforcement can be used.

Figure 2:
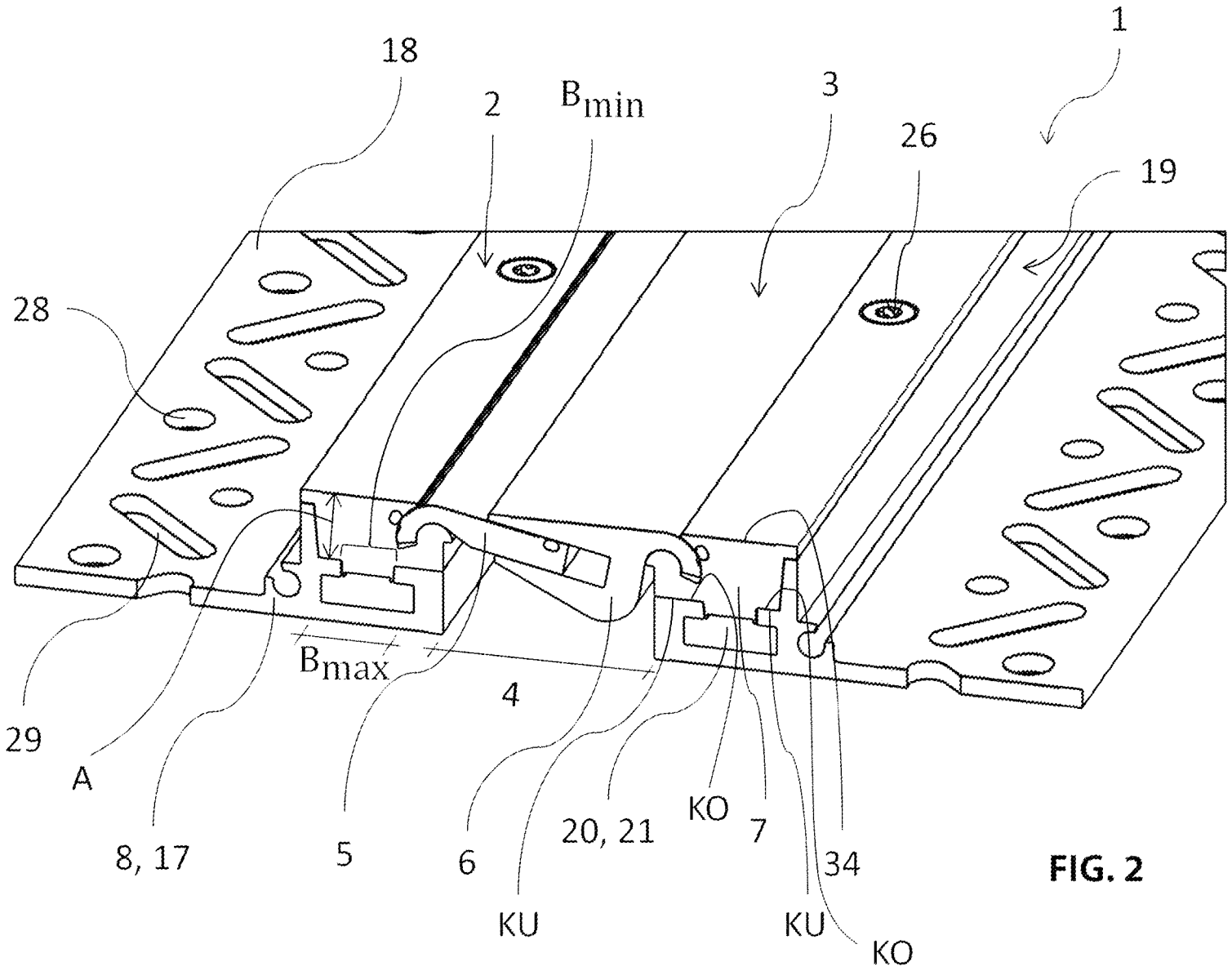
FIG. 2 illustrates a three dimensional view of the gap bridging device according to FIG. 1.

FIG. 2 illustrates the gap bridging device 1 of FIG. 1 according to the invention in a three dimensional view. In FIG. 2 the bore holes 28 and the slotted holes 29 of the base elements 8 of the anchoring devices 2 are clearly visible. By selecting slotted holes 29 it is possible to position the fasteners like e.g. bolts in any way on the surface of the building elements in order to attach the gap bridging device 1. In FIG. 2 the top elements 7 are connected in a force transferring manner with the base elements 8 by bolts 26 and nuts 31 that are arranged in the groove 20.

Figure 3:
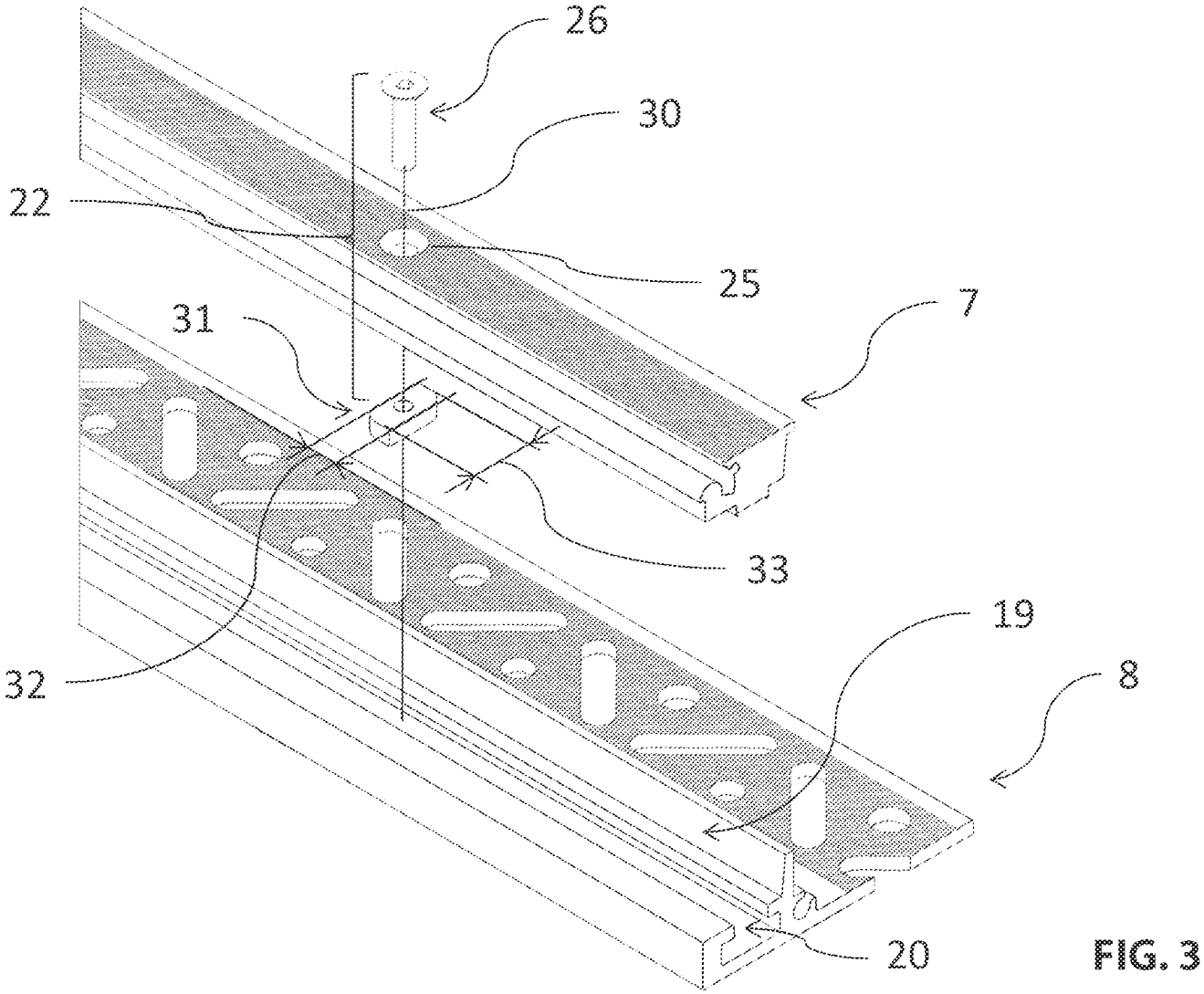
FIG. 3 illustrates an exploded view of the embodiment of the FIG. 2.

FIG. 3 essentially corresponds to FIG. 1, however a bolt 26, the top element 7 of the anchoring device 2, the nut 31 and the base element 8 of the anchoring device 2 are illustrated in an exploded view offset from each other in order to provide a better overview of the individual components.

The nut 31 is configured with a width 32 that is smaller than a minimum width $B_{min}$ of the groove 20 of the base element 8. A length 33 of the nut 31, however, is configured greater than a maximum width $B_{max}$ of the groove 20 of the base element 8 and greater than a minimum width $B_{min}$. Furthermore diagonal edges of the nut 31 are rounded.

In order to connect the top element 7 at a base element 8 that is already bolted together with the respective building element as illustrated by the line 30 in FIG. 3 a bolt 26 is run through the bore hole 28 of the top element 7 and the nut 31 that is provided with a corresponding thread is threaded onto the bolt 26 at a bottom side of the top element. Subsequently the top element 7 that is provided with the bolt 26 and the nut 31 can be inserted into the groove 20 of the base element 8. Thus, the nut 31 has to be threaded into a position that is perpendicular to the illustrated orientation. Since a width 32 of the nut 31 is smaller than the minimum width $B_{min}$ of the base element 8 the top element 7 with the nut 31 can be inserted into the groove 20. The bolt 26 is rotated in order to obtain a firm connection between the two profiles. The nut 31 that is inserted into the groove 20 is moved along in a first step and wedged thereafter as soon as the non-rounded edges come in contact with walls of the groove 20. Due to their shape the nuts 31 advantageously do not have to be inserted into the groove 20 in a lateral direction over long distance and precisely moved to a position of the respective bore hole 25 of the top element 7 before installing the base elements 8.

Figure 4:
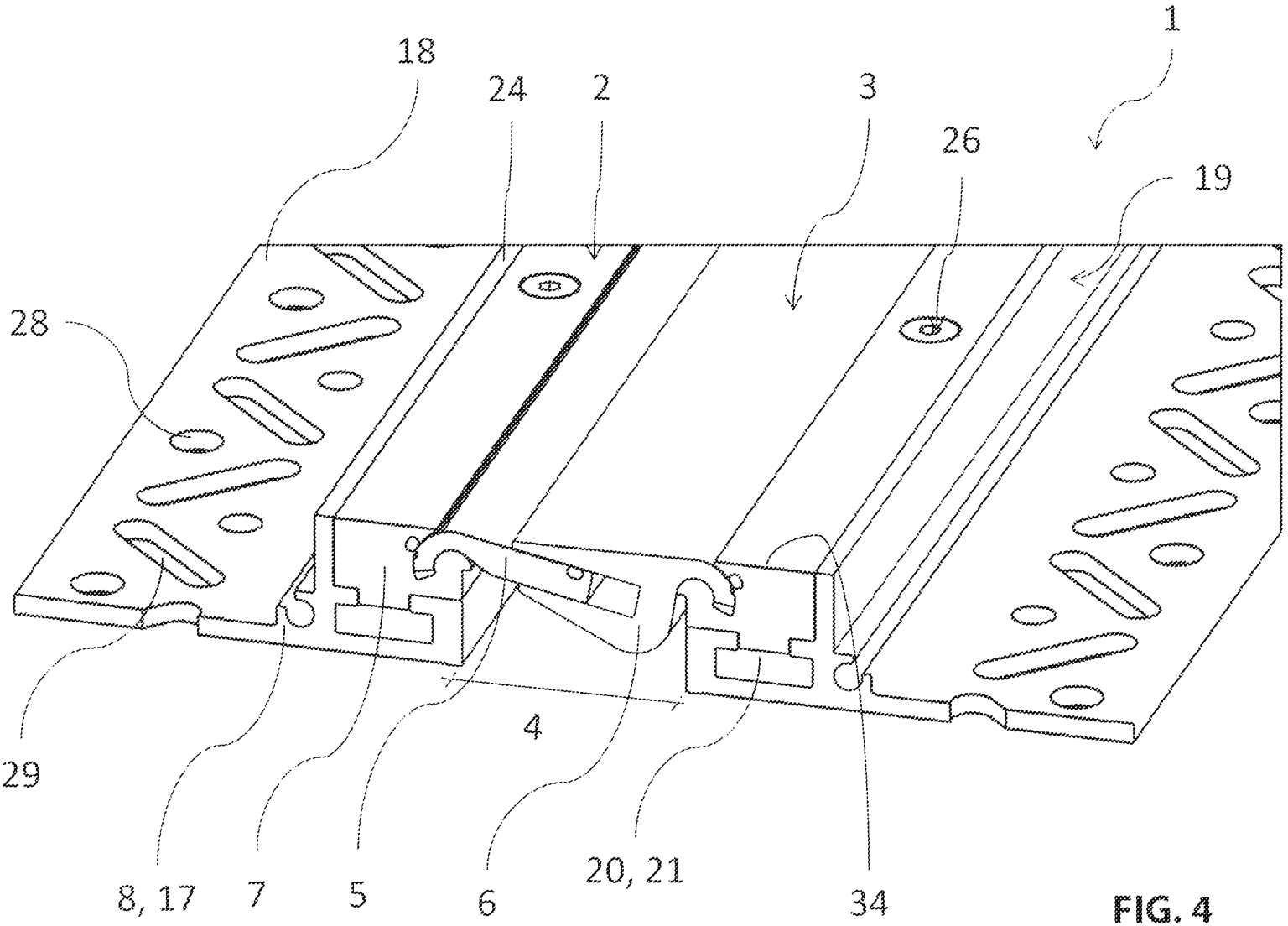
FIG. 4 illustrates a vertical sectional view of a gap bridging device according to the invention.

FIG. 4 illustrates another gap bridging device 1 according to the invention where the flat continuous face 24 of the divider bars 19 extends to the surface 34 of the top element 7 of the anchoring devices 2. The top elements 7 of the anchoring devices 2 are thus completely separated from the flooring material by the divider bars 19. This configuration of the divider bars 19 is particularly advantageous for removing the top elements 7 and the associated bridging device 3 since the recited components can thus be removed without removing or damaging the flooring material. On the other hand side the face 24 of the divider bars 19 is visible in this embodiment so that material differences between the top elements 7 and the base elements 8 are visible which is not the case in the embodiments according to FIGS. 1-3.

REFERENCE NUMERALS AND DESIGNATIONS

1 gap bridging device
2 anchoring device
3 bridging device
4 gap
5 bridging member
6 bridging member
7 top element
8 base element
9 end
10 groove of top element
11 seal thread
12 end
13 groove of second bridging member
14 arm
15 end
16 tongue
17 T-groove rail
18 extension
19 divider bar
20 groove of base element
21 undercut
22 connection element
23 bar
24 face
25 bore hole
26 bolt
27 contact surface
28 bore hole
29 slotted hole
30 line
31 nut
32 width
33 length
34 surface
35 building element
36 flooring material
A distance
$B_{max}$ maximum width
$B_{min}$ minimum width
KO contact surface
KU contact surface

What is claimed is:

1. A gap bridging device, comprising:

two anchoring devices that anchor the gap bridging device at two building elements that are separated from each other by a gap; and a bridging device that is connected with one of the two anchoring devices respectively at longitudinal sides of the bridging device that are arranged opposite to each other, so that position changes of the building elements relative to each other are compensated by a shape-change of the bridging device, wherein the two anchoring devices respectively include a base element that is anchorable at one of the two building elements and a top element that is connected with the base element by a plurality of bolts in a force transferring manner and connected with the gap bridging device, wherein the base element includes a divider bar that extends adjacent to the top element on a side of the top element that is oriented away from the gap so that the divider bar extends towards a surface of a flooring material that adjoins the gap bridging device, wherein the top element is removable from the base element in an installed condition of the base element without causing damage to the gap bridging device or the flooring material, wherein a distance of a face of the divider bar that is oriented towards the surface of the flooring material from the surface of the flooring material is 8 mm at the most, wherein the top element and the base element are supported at each other in a portion of opposing contact surfaces so that forces are transferrable that are orthogonal to the surface of the flooring material, wherein the contact surfaces have a greater distance from the surface of the flooring material than the face of the divider bar, wherein the bridging device includes two adjacent bridging members that are movable relative to each other so that position changes, of the building elements relative to each other are compensable by a movement of the two adjacent bridging members relative to each other, wherein a first bridging member of the two adiacent bridging members is pivotably supported at a first anchoring device of the two anchoring devices and a second bridging member of the two adjacent bridging members is pivotably supported at a second anchoring device of the two anchoring devices, wherein the first bridging member and the second bridging member slide relative to each other in a plane that is inclined relative to a top surface of the flooring material.

2. The gap bridging device according to claim 1, wherein the face of the divider bar extends to a surface of the top element of the anchoring device.

3. The gap bridging device according to claim 1, wherein the face of the divider bar is configured continuously flat.

4. The gap bridging device according to claim 1, wherein the top element of the anchoring device does not extend beyond side surface of the base element that is oriented away from the gap, or wherein the top element of the anchoring device does not extend beyond a side surface of the divider bar of the anchoring device that is oriented away from the gap.

5. The gap bridging device according to claim 1, wherein the gap bridging device includes two top elements and two base elements, wherein the two top elements and the bridging device connected therewith are jointly removable from the two base elements of the two anchoring devices in an installed condition of the two base elements essentially without causing damage to the gap bridging device or the flooring material.

6. The gap bridging device according to claim 1, further comprising:

at least one two-piece connection element, wherein the top element is fixable by the at least one two-piece connection element at the base element, and wherein the at least one two-piece connection element respectively includes a bolt and a nut connected with the bolt.

7. The gap bridging device according to claim 6, wherein a width of the nut of the last least one two-piece connection element is smaller than a length of the nut of the at least one two-piece connection element, wherein the width of the nut of the at least one two-piece connection element is smaller than a minimum width of a groove of the base element, wherein the length of the nut of the at least one two-piece connection element is greater than the minimum width of the groove of the base element, and wherein the length of the nut of the at least one two-piece connection element is greater than a maximum width of the groove of the base element.

8. The gap bridging device according to claim 7, wherein the groove of the base element has a T-shaped cross section.

9. The gap bridging device according to claim 6, wherein two edges of the nut of the at least one two-piece connection element is arranged diagonally relative to each other.

10. The gap bridging device according to claim 1, wherein the first bridging member is slidable directly in the second bringing member to cause the shape change of the bridging element.

11. The gap bridging device according to claim 10, wherein the first bridging member and the second bridging member engage each other directly in a tongue and groove configuration in a telescoping manner.

* * * * *